United States Patent [19]

McDugle et al.

[11] Patent Number: 4,933,272

[45] **Date of Patent: * Jun. 12, 1990**

[54] PHOTOGRAPHIC EMULSIONS CONTAINING INTERNALLY MODIFIED SILVER HALIDE GRAINS

[75] Inventors: Woodrow G McDugle; Anthony D. Gingello, both of Rochester; John A. Haefner, Rush; John E. Keevert, Jr., Rochester; Alfred P. Marchetti, Penfield, all of N.Y.

[73] Assignee: Eastman Kodak Company, Rochester, N.Y.

[ * ] Notice: The portion of the term of this patent subsequent to May 20, 2006 has been disclaimed.

[21] Appl. No.: 179,376

[22] Filed: Apr. 8, 1988

[51] Int. Cl.[5] ..... G03C 1/06

[52] U.S. Cl. ..... 430/567; 430/569; 430/604; 430/605; 430/606; 430/612; 430/596

[58] Field of Search ..... 430/567, 569, 604, 605, 430/606, 612, 596

[56] References Cited

U.S. PATENT DOCUMENTS

| | | | |
|---|---|---|---|
| 2,448,060 | 8/1948 | Trivelli and Smith | 430/603 |
| 3,790,390 | 2/1974 | Shiba et al. | 430/567 |
| 3,890,154 | 6/1975 | Ohkubo et al. | 430/434 |
| 4,126,472 | 11/1978 | Sakai et al. | 430/264 |
| 4,147,542 | 4/1979 | Habu et al. | 430/346 |
| 4,643,965 | 2/1987 | Kubota et al. | 430/567 |
| 4,835,049 | 5/1989 | Janusonis et al. | 430/567 |

FOREIGN PATENT DOCUMENTS

| | | | |
|---|---|---|---|
| 0242190A2 | 10/1987 | European Pat. Off. . | |
| 62-212641 | 9/1987 | Japan | 430/605 |

OTHER PUBLICATIONS

Research Disclosure, vol. 176, Dec. 1978, Item 17643, Section IA.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978.

At the 1982 International Congress of Photographic Science at the University of Cambridge, R. S. Eachus presented a paper titled, "The Mechanism of $Ir^{3+}$ Sensitization of Silver Halide Materials".

B. H. Carroll, "Iridium Sensitization: A Literature Review", *Photographic Science and Engineering,* vol. 24, No. 6, Nov./Dec. 1980, pp. 265–267.

*Primary Examiner*—Roland E. Martin
*Assistant Examiner*—Janet C. Baxter
*Attorney, Agent, or Firm*—Carl O. Thomas

[57] ABSTRACT

Photographic silver halide emulsions are disclosed comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

25 Claims, 1 Drawing Sheet

PHOTOGRAPHIC EMULSIONS CONTAINING INTERNALLY MODIFIED SILVER HALIDE GRAINS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "dopant" refers to a material other than a silver or halide ion contained within a silver halide grain.

The term "transition metal" refers to any element of groups 3 to 12 inclusive of the periodic table of elements.

The term "heavy transition metal" refers to transition metals of periods 5 and 6 of the periodic table of elements.

The term "light transition metal" refers to transition metals of period 4 of the periodic table of elements.

The term "palladium triad transition metals" refers to period 5 elements in groups 8 to 10 inclusive—i.e., ruthenium, rhodium, and palladium.

The term "platinum triad transition metals" refers to period 6 elements in groups 8 to 10 inclusive—i.e., osmium, iridium, and platinum.

The acronym "EPR" refers to electron paramagnetic resonance.

The acronym "ESR" refers to electron spin resonance.

The term "$pK_{sp}$" indicates the negative logarithm of the solubility product constant of a compound.

Grain sizes, unless otherwise indicated, are mean effective circular diameters of the grains, where the effective circular diameter is the diameter of a circle having an area equal to the projected area of the grain.

Photographic speeds are reported as relative speeds, except as otherwise indicated.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during Precipitation of the silver halide grains, before or during the first digestion (physical ripening), before or during the second digestion (chemical ripening), or just before coating, a compound of a palladium or platinum triad transition metal, identified by the general Formula:

$$R_2MX_6$$

wherein

R represents a hydrogen, an alkali metal, or an ammonium radical,

M represents a palladium or platinum triad transition metal, and

X represents a halogen atom—e.g., chlorine or bromine.

The formula compounds are hexacoordinated heavy transition metal complexes which are water soluble. When dissolved in water $R_2$ dissociates as two cations while the transition metal and halogen ligands disperse as a hexacoordinated anionic complex.

With further investigation the art has recognized a distinct difference in the photographic effect of transition metal compounds in silver halide emulsions, depending upon whether the compound is introduced into the emulsion during precipitation of silver halide grains or subsequently in the emulsion making process. In the former instance it has been generally accepted that the transition metal can enter the silver halide grain as a dopant and therefore be effective to modify photographic properties, though present in very small concentrations. When transition metal compounds are introduced into an emulsion after silver halide grain precipitation is complete, the transition metals can be absorbed to the grain surfaces, but are sometimes largely precluded from grain contact by peptizer interactions. Orders of magnitude higher concentrations of transition metals are required to show threshold photographic effects when added following silver halide grain formation as compared to transition metals incorporated in silver halide grains as dopants. The art distinction between metal doping, resulting from transition metal compound addition during silver halide grain formation, and transition metal sensitizers, resulting from transition metal compound addition following silver halide grain formation, is illustrated by *Research Disclosure*, Vol. 176, December 1978, Item 17643, wherein Section IA, dealing with metal sensitizers introduced during grain precipitation, and Section IIIA, dealing with metal sensitizers introduced during chemical sensitization, provide entirely different lists of prior art teachings relevant to each practice. *Research Disclosure* is published by Kenneth Mason Publications, Ltd., Emsworth, Hampshire P010 7DD, England.

Since transition metal dopants can be detected in exceedingly small concentrations in silver halide grains and since usually the remaining elements in the transition metal compounds introduced during grain precipitation are much less susceptible to detection (e.g., halide or aquo ligands or halide ions), grain analysis has focused on locating and quantifying the transition metal dopant concentration in the grain structure. While Trivelli and Smith taught to employ only anionic hexacoordinated halide complexes of transition metals, many if not most listings of transition metal compounds to be introduced during silver halide grain formation have indiscriminately lumped together simple salts of transition metals and transition metal complexes. This is evidence that the possibility of ligand inclusion in grain formation or any modification in performance attributable thereto was overlooked.

In fact, a survey of the photographic literature identifies very few teachings of adding to silver halide emulsions during grain formation compounds of transition metals in which the transition metal is other than a palladium and platinum triad transition metal and the remainder of the compound is provided by other than halide ligands, halide and aquo ligands, halides which dissociate to Form anions in solution, or ammonium or alkali metal moieties that dissociate to form cations in solution. The following is a listing of the few variant teachings that have been identified Shibe et al U.S. Pat. No. 3,790,390 discloses preparing a blue responsive silver halide emulsion suitable for flash exposure which can be handled under bright yellowish-green light. The emulsion contains grains with a mean size no larger than 0.9 μm, at least one group 8–10 metal compound, and a formula specified merocyanine dye. Examples of transition metal compounds are simple salts of light transition metals, such as iron, cobalt, and nickel salts, and hexacoordinated complexes of light transition metals containing cyanide ligands. Heavy transition metal compounds are disclosed only as the usual simple salts or hexacoordinated complexes containing only halide ligands. Palladium (II) nitrate, a simple salt, is also disclosed as well as palladium tetrathiocyanatopalladate (II), a tetracoordinated complex of palladium.

Ohkubo et al. U.S. Pat. Nos. 3,890,154 and Habu et al. 4,147,542 are similar to Shiba et al., differing principally in employing different sensitizing dyes to allow recording of green flash exposures.

Sakai et al. U.S. Pat. No. 4,126,572 discloses producing a high contrast emulsion suitable for lithe photography by ripening an emulsion containing at least 60 mole percent silver chloride in the presence of $10^{-6}$ to $10^{-4}$ mole per mole of silver halide of a water soluble iridium salt and further adding a hydroxytetraazaindene and a polyoxyethylene compound. In addition to the usual iridium halide salts and hexacoordinated iridium complexes containing halide ligands Sakai et al. discloses cationic hexacoordinated complexes of iridium containing amine ligands. Since iridium is introduced after silver halide precipitation is terminated, the iridium is not employed as a grain dopant, but as a grain surface modifier. This undoubtedly accounts for the variance from conventional iridium compounds used for doping.

D. M. Samoilovich, "The Influence of Rhodium and Other polyvalent Ions on the photographic properties of Silver Halide Emulsions", in a paper presented to 1978 International Congress of photographic Science, Rochester Institute of Technology, Aug 20–26, 1978, reported investigations of chloride iridium, rhodium, and gold complexes and, in addition, an emulsion prepared by introducing $(NH_4)_6Mo_7O_{24}4H_2O$. The latter dissociates in water molybdenum cluster having a net negative charge of −6. Neither the +6 oxidation state ascribed to molybdenum nor the −6 valence of the anionic cluster should be confused with a hexacoordinated complex of a single transition metal atom.

At the 1982 International Congress of Photographic Science at the University of Cambridge, R. S. Eachus presented a paper titled, "The Mechanism of $Ir^{3+}$ Sensitization of Silver Halide Materials", wherein inferential electron paramagnetic resonance (EPR) spectroscopic evidence was presented that $Ir^{3+}$ ions were incorporated into melt-grown silver bromide and silver chloride crystals as $(IrBr_6)^{-3}$ and $(IrCl_6)^{-3}$. In emulsions and sols of these salts, the hexabromoiridate and hexachloroiridate molecular ions, as well as similar complexes containing mixed halides, were introduced during precipitation. The aquated species $[IrCl_4(H_2O)_2]^{-1}$ and $[IrCl_5(H_2O)]^{-2}$ were also successfully doped into precipitates of both silver salts. Eachus went on to speculate on various mechanisms by which incorporated iridium ions might contribute to photogenerated free electron and hole management, including latent image formation.

B. H. Carroll, "Iridium Sensitization: A Literature Review", *Photographic Science and Engineering*, Vol. 24, No. 6, November/December 1980, pp. 265–267, is cited for further background on conventional photographic uses of iridium.

Greskowiak published European Patent Application No. 0,242,190/A2 discloses reductions in high intensity reciprocity failure in silver halide emulsions formed in the presence of one or more complex compounds of rhodium (III) having 3, 4, 5, or 6 cyanide ligands attached to each rhodium ion.

RELATED PATENT APPLICATIONS

Keevert et al. U.S. Ser. No. 179,377, concurrently filed and commonly assigned, titled PHOTOGRAPHIC EMULSIONS CONTAINING INTERNALLY MODIFIED SILVER HALIDE GRAINS, discloses photographic emulsions comprised of radiation sensitive silver halide grains containing greater than 50 mole percent chloride and less than 5 mole percent iodide, based on total silver, with any residual halide being bromide. The grains exhibit a face centered cubic crystal structure formed in the presence of a hexacoordination complex of rhenium, ruthenium, or osmium with at least four cyanide ligands. The emulsions exhibit increased sensitivity.

Marchetti et al. U.S. Ser. No. 179,378, concurrently filed and commonly assigned, titled PHOTOGRAPHIC EMULSIONS CONTAINING INTERNALLY MODIFIED SILVER HALIDE GRAINS, discloses photographic emulsions comprised of radiation sensitive silver bromide or bromoiodide grains which exhibit a face centered cubic crystal structure formed in the presence of a hexacoordination complex of rhenium, ruthenium, or osmium with at least four cyanide ligands. The emulsions exhibit increased stability. Also, reductions in low intensity reciprocity failure are observed in these emulsions.

Janusonis et al., U.S. Ser. No. 179,380, concurrently filed and commonly assigned, titled INTERNALLY DOPED SILVER HALIDE EMULSIONS, now U.S. Pat. No. 4,835,093, discloses photographic emulsions comprised of silver halide grains exhibiting a face centered cubic crystal lattice structure and internally containing rhenium.

SUMMARY OF THE INVENTION

Silver halide photography serves a wide spectrum of imaging needs. The amateur 35 mm photographer expects to capture images reliably over the full range of shutter speeds his or her camera offers, typically ranging from 1/10 of second or longer to 1/1000 of a second or less, under lighting conditions ranging from the most marginal twilight to mid-day beach and ski settings, with pictures being taken in a single day or over a period of months and developed immediately or months after taking, with the loaded camera often being left in an automobile in direct sun and stifling heat in the summer or overnight in mid-winter. These are stringent demands to place on the complex chemical system which the film represents. Parameters such as speed, contrast, fog, pressure sensitivity, high and low intensity reciprocity failures, and latent image keeping are all important in achieving acceptable photographic performance.

While specialized and professional photography seldom places such diverse demands on a single film as the amateur photographer, even more stringent performance criteria are routinely encountered that must be invariantly satisfied. Action and motion study photography requires extremely high photographic speeds. High shutter speeds often require high intensity exposures. For such applications high intensity reciprocity failure must be avoided. Astronomical photography also requires high levels of photographic sensitivity, but exposure times can extend for hours to capture light from faint celestial objects. For such applications low intensity reciprocity failure is to be avoided. For medical radiography high photographic speeds are required and resistance to localized pressure modification of sensitivity (e.g., kink desensitization) is particularly important in larger formats. Portrait photography requires a choice of contrasts, ranging from low to moderately high, to obtain the desired viewer response. Graphic arts photography requires extremely high levels of contrast. In some instances speed reduction (partial desensitization) is desired to permit handling of the film under less visually fatiguing lighting conditions (e.g., room light and/or green or yellow light) than customary red safe lighting. Color photography requires careful matching of the blue, green, and red photographic records, over the entire useful life of a film. While most silver halide photographic materials produce negative images, positive images are required for many applications. Both direct positive imaging and positive imaging of negative-working photographic materials by reversal processing serve significant photographic needs.

In attempting to tailor the properties of silver halide photographic materials to satisfy specific imaging requirements, there has emerged a general recognition of the utility of transition metal dopants in radiation-sensitive silver halide grains. Progress in modifying emulsion properties by transition metal doping has, however, reached a plateau, since there are only a limited number of transition metals as well as a limited number of possible transition metal concentrations and placements within the grain.

The present invention is based on the recognition that transition metal complexes, including both the transition metal and its ligands, can be included internally within the face centered cubic crystal structure of radiation-sensitive silver halide grains to modify photographic properties. Further, the ligands as well as the transition metal play a significant role in determining photographic performance. By choosing one or more novel ligands for incorporation in the silver halide grains, useful modifications of silver halide photographic emulsions can be realized.

In one aspect this invention is directed to a photographic silver halide emulsion comprised of radiation-sensitive silver halide grains exhibiting a face centered cubic crystal lattice structure internally containing a nitrosyl or thionitrosyl coordination ligand and a transition metal chosen from groups 5 to 10 inclusive of the periodic table of elements.

DESCRIPTION OF PREFERRED EMBODIMENTS

Figure 1:
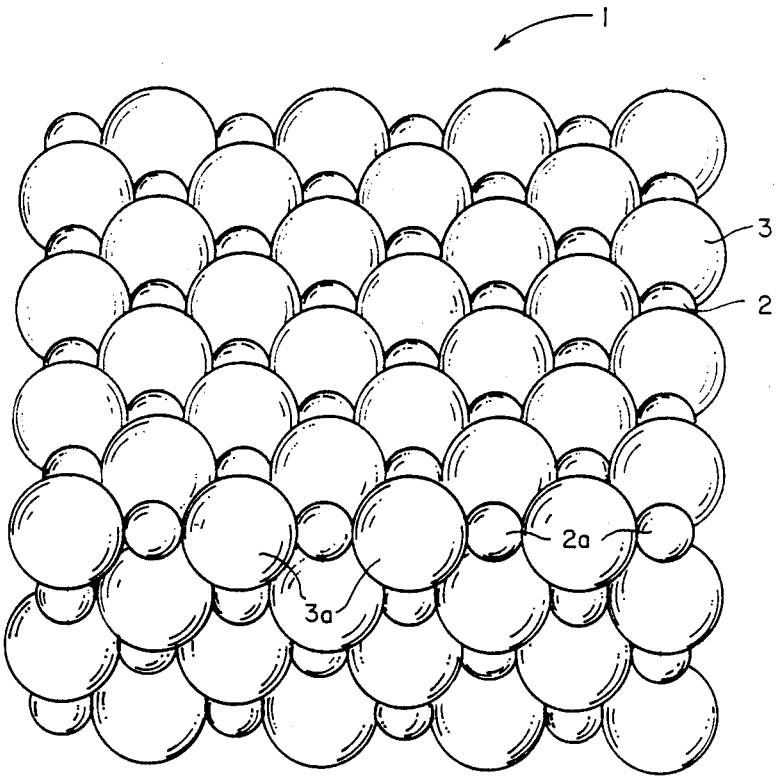
FIG. 1 is a schematic view of a silver bromide crystal structure with the upper layer of ions lying along a {100} crystallographic face.

Unlike silver iodide, which commonly forms only $\beta$ and $\gamma$ phases, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of ions shown counting from the bottom of FIG. 1 lie in a {100} crystallographic plane which perpendicularly intersects the {100} crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The arrangement of ions in a silver chloride crystal is the same as that shown in FIG. 1, except that chloride ions are smaller then bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are larger than the bromide ions. As much as 40 mole percent of the total halide in a silver bromide cubic crystal lattice structure can be accounted for by iodide ions before silver iodide separates as a separate phase. In photographic emulsions iodide concentrations in silver halide grains seldom exceed 20 mole percent and are typically less than 10 mole percent, based on silver. However, specific applications differ widely in their use of iodide. Silver bromoiodide emulsions are employed in high speed (ASA 100 or greater) camera films, since the presence of iodide allows higher speeds to be realized at any given level of granularity. Silver bromide emulsions or silver bromoiodide emulsions containing less than 5 mole percent iodide are customarily employed for radiography. Emulsions employed for graphic arts and color paper typically contain greater than 50 mole percent, preferably greater than 70 mole percent, and optimally greater than 85 mole percent, chloride, but less than 5 mole percent, preferably less than 2 mole percent, iodide, any balance of the halide not accounted for by chloride or iodide being bromide.

The present invention is concerned with photographic silver halide emulsions in which a transition metal complex has been internally introduced into the cubic crystal structure of the grain. The parameters of such an incorporated complex can be roughly appreciated by considering the characteristics of a single silver ion and six adjacent halide ions (hereinafter collectively referred to as the seven vacancy ions) that must be omitted from the crystal structure to accommodate spatially a hexacoordinated transition metal complex. The seven vacancy ions exhibit a net charge of $-5$. This suggests that anionic transition metal complexes should be more readily incorporated in the crystal structure than neutral or cationic transition metal complexes.

This also suggests that the capability of a hexacoordinated transition metal complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare elements and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions, which are still larger than bromide ions. This suggests that the size of 5th and 6th period transition metals should not in itself provide any barrier to their incorporation. A final observation that can be drawn from the seven vacancy ions is that the six halide ions exhibit an ionic attraction not only to the single silver ion that forms the center of the vacancy ion group, but are also attracted to other adjacent silver ions.

The present invention employs within silver halide grains transition metal complexes containing a central transition metal ion and coordinated ligands. The preferred coordination complexes for incorporation are hexacoordination complexes, since the transition metal ion can take the place of a silver ion with the six coordination ligands taking the place of six halide ions next adjacent to the displaced silver ion. Alternatively, the coordination complex can be another polycoordination complex, such as a tetracoordination complex. Such complexes exhibit a planar form that can be substituted for one of the silver ions and next adjacent halide ions lying in a single plane forming the crystal lattice structure. Both tetracoordinated and hexacoordinated complexes exhibit a spatial configuration that is compatible with the face centered cubic crystal structure of photographically useful silver halides. The hexacoordinated complexes are most compatible, since the six ligands are spatially comparable to the six halide ions next adjacent to a silver ion in the crystal structure.

To appreciate that a coordination complex of a transition metal having ligands other than halide ligands or, as recognized by Eachus, cited above, aquo ligands, can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a coordination complex can be spatially accommodated into a silver halide crystal structure in the space that would otherwise be occupied by the vacancy ions, even though the number and/or diameters of the individual atoms forming the complex exceeds that of the vacancy ions. This is because the covalent bond strength can significantly reduce bond distances and therefore the size of the entire complex. It is a specific recognition of this invention that multielement ligands of transition metal coordination complexes can be spatially accommodated to single halide ion vacancies within the crystal structure.

While spatial compatibility is important in choosing suitable transition metal coordination complexes, another factor which must be taken into account is the compatibility of the complex with the next adjacent ions in the crystal lattice structure. It is the recognition of this invention that compatibility can be realized by choosing bridging ligands for the transition metal complex. Looking at a single row of silver and halide ions in a cubic crystal lattice structure, the following relationship can be observed:

$$Ag^+X^-Ag^+X^-Ag^+X^-Ag^+X^-, \text{ etc.}$$

Notice that the halide ions X are attracting both adjacent silver ions in the row. When the portion of a transition metal coordination complex lying in a single row of silver and halide ions in a crystal structure is considered, the following relationship can be observed:

$$Ag^+X^-Ag^+—L—M—L—Ag^+X^-, \text{ etc.}$$

where

M represents a transition metal and

L represents a bridging ligand.

While only one row of silver and halide ions is shown, it is appreciated that the complex forms part of three identical perpendicular rows of silver and halide ions having the transition metal M as their point of intersection. Tetracoordination complexes place ligands in each of two intersecting rows lying in a common plane while hexacoordination complexes place ligands in each of three identical intersecting rows of ions.

Bridging ligands are those which can serve as bridging groups between two or more metal centers. Bridging ligands can be either monodentate or ambidentate. A monodentate bridging ligand has only one ligand atom that forms two (or more) bonds to two (or more) different metal atoms. For monoatomic ligands, such as halides, and for ligands containing only one possible donor atom, the mondentate form of bridging is the only possible one. Multielement ligands with more than one donor atom can also function in a bridging capacity and are referred to as ambidentate ligands.

Transition metal coordination complexes satisfying the requirements of this invention are those which contain one or more nitrosyl or thionitrosyl ligands. Nitrosyl ligands are generally recognized to be bridging ligands exhibiting the structure $$-\overset{\overset{\displaystyle O}{\|}}{N}-$$

On the other hand, thionitrosyl (—NS) ligands cannot be categorized with certainty as being strictly monodentate or strictly ambidentate ligands. While bonding to the transition metal is through the nitrogen atom, it would be reasonable to expect attraction of a neighboring silver ion through either of the nitrogen or sulfur atom.

By considering the crystal structure of silver halide it is apparent that the art has in all probability been fully justified in employing simple transition metal halide salts and hexacoordinated transition metal complexes containing only halide ligands interchangeably to obtain identical photographic effects. Not only has the art failed to recognize any advantage or modification in photographic properties attributable to halide ion inclusion, it has also failed to observe any photographic property modification attributable to aquo ligand inclusion. On this latter point, it should be noted that silver halide grains are routinely precipitated in aqueous media containing halide ions, raising significant doubts about whether any grain structure modification was achieved by the substitution of one or two aquo ligands for halide ligands in hexacoordinated metal transition complexes. There are two possible explanations, either aquo ligands may exchange with halide ions prior to or during precipitation or aquo occlusions may be more common than generally appreciated.

The present invention runs counter to the accepted teachings of the art. The art has conducted extensive experimental investigation in the 40 years following the discoveries of Trivelli and Smith, cited above, and reported that similar photographic performance is realized whether transition metals are internally introduced into silver halide grains by addition to the precipitation medium as simple salts, haloligand transition complexes, or comparable halo complexes having one or more of the halo ligands displaced by aquo ligands.

The essential contribution which this invention makes to the art is the recognition that nitrosyl and/or thionitrosyl ligands of transition metal coordination complexes can play a significant role in modifying photographic performance. Preferred transition metal coordination complexes satisfying the requirements of this invention are hexacoordination complexes represented by the formula:

$$[ML_4(NY)L']^n \quad (I)$$

where

M is a transition metal chosen from groups 5 to 10 inclusive of the periodic table of elements;

L is a bridging ligand;

L' is L or (NY);

Y is oxygen or sulfur; and n is zero, −1, −2, or −3.

The present invention contemplates photographic emulsions in which the radiation sensitive grains of a cubic crystal lattice structure internally contains a transition metal coordination complex, preferably a hexacoordination transition metal complex, containing at least one novel (to this environment) nitrosyl or thionitrosyl ligand for modifying photographic performance. The remaining ligands can be any convenient choice of bridging ligands, including additional nitrosyl or thionitrosyl bridging ligands.

Specific examples of preferred bridging ligands other than nitrosyl and thionitrosyl ligands include aquo ligands, halide ligands (specifically, fluoride, chloride, bromide, and iodide), cyanide ligands, cyanate ligands, thiocyanate ligands, selenocyanate ligands, tellurocyanate ligands, and azide ligands. Still other bridging ligand choices are possible. The nitrosyl or thionitrosyl ligands preferably account for one or two of the total ligands and aquo ligands, when present, also preferably account for only one or two of the ligands. Hexacoordinated transition metal complexes which include in addition to their nitrosyl and thionitrosyl ligands up to five halide and/or cyanide ligands are specifically preferred.

Any transition metal capable of forming a coordination complex can be employed in the practice of the invention. The transition metals of groups 5 to 10 inclusive of the periodic table are known to form tetracoordination and hexacoordination complexes. Preferred transition metals in groups 5 to 7 inclusive are the light (4th period) transition metals while in groups 8 to 10 inclusive the platinum and palladium triads of heavy transition metals are preferred.

The transition metal coordination complexes contemplated for grain incorporation in most instance exhibit a net ionic charge. One or more counter ions are therefore usually associated with the complex to form a charge neutral compound. The counter ion is of little importance, since the complex and its counter ion or ions dissociated upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

Table I provides a listing of illustrative compounds of hexacoordinated transition metal complexes satisfying the requirements of the invention:

TABLE I

| | |
|---|---|
| TMC-1 | $[V(NO)(CN)_5]^{-3}$ |
| TMC-2 | $[CR(NO)(CN)_5]^{-3}$ |
| TMC-3 | $[MN(NO)(CN)_5]^{-3}$ |
| TMC-4 | $[Fe(NO)(CN)_5]^{-2}$ |
| TMC-5 | $[Ru(NO)Cl_5]^{-2}$ |
| TMC-6 | $[Ru(NO)Br_5]^{-2}$ |
| TMC-7 | $[Ru(NO)I_5]^{-2}$ |
| TMC-8 | $[Ru(NO)F_5]^{-2}$ |
| TMC-9 | $[Ru(NO)Cl_3(H_2O)_2]^0$ |
| TMC-10 | $[Ru(NO)Cl_3Br(H_2O)]^{-1}$ |
| TMC-11 | $[Ru(NO)Cl_4(OCN)]^{-2}$ |
| TMC-12 | $[Ru(NO)Cl_4(CN)]^{-2}$ |
| TMC-13 | $[Ru(NO)I_4(TeCN)]^{-2}$ |
| TMC-14 | $[Ru(NO)Cl_4(SCN)]^{-2}$ |
| TMC-15 | $[Ru(NO)Br_4(SeCN)]^{-2}$ |
| TMC-16 | $[Ru(NO)I_4(SeCN)]^{-2}$ |
| TMC-17 | $[Ru(NO)Cl_3(CN)_2]^{-2}$ |
| TMC-18 | $[Ru(NO)Br_2(CN)_3]^{-2}$ |
| TMC-19 | $[Ru(NO)I_2(CN)_3]^{-2}$ |
| TMC-20 | $[Ru(NO)Cl_4(N_3)]^{-2}$ |
| TMC-21 | $[Ru(NO)Cl(CN)_4]^{-2}$ |
| TMC-22 | $[Ru(NO)Br(SCN)_4]^{-2}$ |
| TMC-23 | $[Ru(NO)I(CN)_4]^{-2}$ |
| TMC-24 | $[Ru(NO)(CN)_5]^{-2}$ |
| TMC-25 | $[Os(NO)Cl_5]^{-2}$ |
| TMC-26 | $[Os(NO)Br_5]^{-2}$ |
| TMC-27 | $[Os(NO)I_5]^{-2}$ |
| TMC-28 | $[Os(NO)F_5]^{-2}$ |
| TMC-29 | $[Os(NO)Cl_4(TeCN)]^{-2}$ |
| TMC-30 | $[Os(NO)Br_4(OCN)]^{-2}$ |
| TMC-31 | $[Os(NO)I_4(TeCN)]^{-2}$ |
| TMC-32 | $[Os(NO)Cl_4(SeCN)]^{-2}$ |
| TMC-33 | $[Os(NO)Br_4(SeCN)]^{-2}$ |
| TMC-34 | $[Os(NO)I_4(SeCN)]^{-2}$ |
| TMC-35 | $[Os(NO)Cl_3(CN)_2]^{-2}$ |
| TMC-36 | $[Os(NO)Br_2(CN)_3]^{-2}$ |
| TMC-37 | $[Os(NO)I_2(SCN)_3]^{-2}$ |
| TMC-38 | $[Os(NO)Cl_2(SCN)_3]^{-2}$ |
| TMC-39 | $[Os(NO)Cl(CN)_4]^{-2}$ |
| TMC-40 | $[Os(NO)Br(CN)_4]^{-2}$ |
| TMC-41 | $[Os(NO)I(SCN)_4]^{-2}$ |
| TMC-42 | $[Os(NO)(CN)_5]^{-2}$ |
| TMC-43 | $[Re(NO)(CN)_5]^{-2}$ |
| TMC-44 | $[Re(NO)Cl_5]^{-2}$ |
| TMC-45 | $[Re(NO)Br_5]^{-2}$ |
| TMC-46 | $[Re(NO)Cl_2(CN)_3]^{-2}$ |
| TMC-47 | $[Ir(NO)Cl_5]^{-1}$ |
| TMC-48 | $[Ir(NO)Br_5]^{-1}$ |
| TMC-49 | $[Ir(NO)I_5]^{-1}$ |
| TMC-50 | $[Ir(NO)Cl_3BrI]^{-1}$ |
| TMC-51 | $[Ru(NS)Cl_5]^{-2}$ |
| TMC-52 | $[Os(NS)Br_5]^{-2}$ |
| TMC-53 | $[Ru(NS)I_5]^{-2}$ |
| TMC-54 | $[Os(NS)Cl_4(N_3)]^{-2}$ |
| TMC-55 | $[Ru(NS)Br_4(N_3)]^{-2}$ |
| TMC-56 | $[Os(NS)I_4(N_3)]^{-2}$ |
| TMC-57 | $[Ru(NS)Cl_4(CN)]^{-2}$ |
| TMC-58 | $[Os(NS)Br_4(CN)]^{-2}$ |
| TMC-59 | $[Ru(NS)I_4(CN)]^{-2}$ |
| TMC-60 | $[Os(NS)Cl_4(SCN)]^{-2}$ |

TABLE I-continued

| | |
|---|---|
| TMC-61 | $[Ru(NS)Br_4(SCN)]^{-2}$ |
| TMC-62 | $[Os(NS)I_4(SCN)]^{-2}$ |
| TMC-63 | $[Ru(NS)Cl_4(SeCN)]^{-2}$ |
| TMC-64 | $[Os(NS)Br_4(SeCN)]^{-2}$ |
| TMC-65 | $[Ru(NS)I_4(SeCN)]^{-2}$ |
| TMC-66 | $[Os(NS)Cl_3(N_3)_2]^{-2}$ |
| TMC-67 | $[Ru(NS)Br_3(CN)_2]^{-2}$ |
| TMC-68 | $[Os(NS)Cl_3(SCN)_2]^{-2}$ |
| TMC-69 | $[Ru(NS)Cl_3(SeCN)_2]^{-2}$ |
| TMC-70 | $[Ru(NS)Cl_2(N_3)_3]^{-2}$ |
| TMC-71 | $[Ru(NS)I_2(CN)_3]^{-2}$ |
| TMC-72 | $[Os(NS)Br_2(SCN)_3]^{-2}$ |
| TMC-73 | $[Ru(NS)Cl_2(SeCN)_3]^{-2}$ |
| TMC-74 | $[Ru(NS)Cl_2(N_3)_3]^{-2}$ |
| TMC-75 | $[Os(NS)I_2(CN)_3]^{-2}$ |
| TMC-76 | $[Ru(NS)Br_2(SCN)_3]^{-2}$ |
| TMC-77 | $[Os(NS)Cl_2(SeCN)_3]^{-2}$ |
| TMC-78 | $[Os(NS)Cl(N_3)_4]^{-2}$ |
| TMC-79 | $[Ru(NS)I(CN)_4]^{-2}$ |
| TMC-80 | $[Ru(NS)Cl(SCN)_4]^{-2}$ |
| TMC-81 | $[Os(NS)Cl(SeCN)_4]^{-2}$ |
| TMC-82 | $[Ru(NS)(CN)_5]^{-2}$ |
| TMC-83 | $[Ru(NS)(SCN)_5]^{-2}$ |
| TMC-84 | $[Os(NS)(SeCN)_5]^{-2}$ |
| TMC-85 | $[Ru(NS)(N_3)_5]^{-2}$ |
| TMC-86 | $[Mo(NO)_2(CN)_4]^{-2}$ |

Procedures for beginning with the compounds of Table I and preparing photographic silver halide emulsions benefitted by incorporation of the hexacoordinated transition metal complex can be readily appreciated by considering the prior teachings of the art relating to introducing transition metal dopants in silver halide grains. Such teachings are illustrated by Wark U.S. Pat. Nos. 2,717,833; Berriman 3,367,778; Burt 3,445,235; Bacon et al. 3,446,927; Colt 3,418,122; Bacon 3,531,291; Bacon 3,574,625; Japanese Patent No. (Kokoku) 33781/74 (priority 10 May 1968); Japanese Patent No. (Kokoku) 30483/73 (priority 2 Nov. 1968); Ohkubo et al. U.S. Pat. No. 3,890,154; Spence et al. U.S. Pat. Nos. 3,687,676 and 3,690,891; Gilman et al. 3,979,213; Motter 3,703,584; Japanese Patent No. (Kokoku) 32738/70 (priority 22 Oct. 1970); Shiba et al. U.S. Pat. Nos. 3,790,390; Yamasue et al. 3,901,713; Nishina et al. 3,847,621; *Research Disclosure*, Vol. 108, Apr. 1973, Item 10801; Sakai U.S. Pat. No. 4,126,472; Dostes et al. Defensive Publication T962,004 and French Patent No. 2,296,204; U.K. Specification No. 1,527,435 (priority 17 Mar. 1975); Japanese Patent Publication No. (Kokai) 107,129/76 (priority 18 Mar. 1975); Habu et al. U.S. Pat. Nos. 4,147,542 and 4,173,483; *Research Disclosure*, Vol. 134, June 1975, Item 13452; Japanese Patent No. Publication (Kokai) 65,432/77 (priority 26 Nov. 1975); Japanese Patent Publication No. (Kokai) 76,923/77 (priority 23 Dec. 1975); Japanese Patent Publication No. (Kokai) 88,340/77 (priority 26 Jan. 1976); Japanese Patent Publication No. (Kokai) 75,921/78 (priority 17 Dec. 1976); Okutsu et al. U.S. Pat. No. 4,221,857; Japanese Patent Publication No. (Kokai) 96,024/79 (priority 11 Jan. 1978); *Research Disclosure*. Vol. 181, May 1979, Item 18155; Kanisawa et al. U.S. Pat. No. 4,288,533; Japanese Patent Publication No. (Kokai) 25,727/81 (priority 7 Aug. 1979); Japanese Patent Publication No. (Kokai) 51,733/81 (priority 2 Oct. 1979); Japanese Patent Publication No. (Kokai) 166,637/80 (priority 6 Dec. 1979); and Japanese Patent Publication No. (Kokai) 149,142/81 (priority 18 Apr. 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver chloride to 16.09 for silver iodide at room temperature. For a transition metal complex to coprecipitate with silver halide it must also form a high $pK_{sp}$ compound. If the $pK_{sp}$ is too low, precipitation may not occur. On t other hand, if the $pK_{sp}$ is too high, the compound may precipitate as a separate phase. Optimum $pK_{sp}$ values for silver or halide counter ion compounds of transition metal complexes should be in or near the range of $pK_{sp}$ values for photographic silver halides—that is, in the range of from about 8 to 20, preferably about 9 to 17. Since transition metal complexes having only halide ligands or only aquo and halide ligands are known to coprecipitate with silver halide, substitution of only one or two novel ligands is generally compatible with coprecipitation. All of the ligands of formula I form silver compounds within the contemplated $pK_{sp}$ ranges and form transition metal complexes capable of coprecipitation, even when they account for all of the ligands of a complex.

The transition metal complexes satisfying the requirements of the invention can be incorporated in silver halide grains in the same concentrations, expressed in moles per mole of silver, as have been conventionally employed for transition metal doping. An extremely wide range of concentrations has been taught, ranging from as low as $10^{-10}$ mole/Ag mole taught by Dostes et al., cited above, for reducing low intensity-reciprocity failure and kink desensitization in negative-working emulsions, to concentrations as high as $10^{-3}$ mole/Ag mole, taught by Spencer et al., cited above, for avoidance of dye desensitization. While useful concentrations can vary widely, depending upon the halide content of the grains, the transition metal selected, its oxidation state, the specific ligands incorporated, and the photographic effect sought, concentrations of less than $10^{-6}$ mole/Ag mole are contemplated for improving the performance of surface latent image forming emulsions without surface desensitization. Concentrations of from $10^{-9}$ to $10^{-6}$ have been widely suggested. Graphic arts emulsions seeking to employ transition metals to increase contrast with incidental or even intentionally sought speed loss often range somewhat higher in transition metal dopant concentrations than other negative-working emulsions, with concentrations of up to $10^{-4}$ mole/Ag mole being common. For internal electron trapping, as is commonly sought in direct positive emulsions, concentrations of greater than $10^{-6}$ mole/Ag mole are generally taught, with concentrations in the range of from $10^{-6}$ to $10^{-4}$ mole/Ag mole being commonly employed.

Apart from the incorporated transition metal coordination complexes satisfying the requirements of the invention the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure*. Item 17643, cited above, the disclosure of which is here incorporated by reference. It is specifically contemplated to incorporate transition metal coordination complexes satisfying the requirements of this invention in tabular grain emulsions, particularly thin (less than 0.2 μm) and/or high aspect ratio (>8:1) tabular grain emulsions, such as those disclosed in Wilgus et al. U.S. Pat. Nos. 4,434,226; Kofron et al. 4,439,520; Daubendiek et al. 4,414,310, 4,693,964, and 4,672,027; Abbott et al. 4,425,425 and 4,425,426; Wey 4,399,215; Solberg et al. 4,433,048; Dickerson 4,414,304; Mignot 4,386,156; Jones et al. 4,478,929; Evans et al. 4,504,570; Maskasky 4,400,463, 4,435,501, 4,643,966, 4,684,607, 4,713,320, and 4,713,323; Wey et al. 4,414,306; and Sowinski et al. 4,656,122; the disclosures of which are here incorporated by reference.

The following are specific illustrations of how incorporated hexcoordinated transition metal complexes satisfying the requirements of this invention can be employed for achieving specific photographic improvements:

A. NON-HALIDE SPECIFIC ADVANTAGES

The advantages discussed in this Section A can be realized with any silver halide exhibiting a face centered cubic crystal lattice structure. The specific advantages described below have been observed in both high chloride emulsions, described more specifically in Section B below, and silver bromide emulsions optionally containing iodide. The iodide can be present in the emulsion up to its solubility limit in silver bromide, about 40 mole percent, but is typically present in concentrations of less than 20 mole percent, more typically less than 10 mole percent, based on total silver. Essentially similar results are achieved by complex incorporation according to the invention whether iodide is present or absent from the emulsion.

A-1. Fogged Direct Positive Emulsions

It is specifically contemplated to incorporate in the grains of prefogged direct positive emulsions or direct positive photobleach emulsions (described as a class in James, *The Theory of the Photographic Process*, Macmillan, 4th Ed., 1977, pp. 185 and 186) any of the complexes satisfying formula I. Useful concentrations range from as little as $10^{-8}$ mole per silver mole up to the solubility limit of the complex, typically about $10^{-3}$ mole per silver mole. Typical concentrations contemplated are in the range of from about $10^{-6}$ to $10^{-4}$ mole per silver mole.

Photobleach emulsions of the type contemplated employ surface fogged silver halide grains. Exposure results in photogenerated holes bleaching the surface fog. Increased sensitivity of the emulsions by complex incorporation is indicative that the complex is internally trapping electrons. This avoids recombination of photogenerated hole-electron pairs which reduces the population of holes available for surface bleaching of fog.

As is well understood in the art, substantial advantages in speed are realized by employing a combination of reduction and gold sensitizers to generate surface fog. Examples of emulsions of this type are those containing grains internally incorporating complexes as described above and otherwise conforming to the teachings of Berriman U.S. Pat. No. 3,367,778 and Illingsworth U.S. Pat. Nos. 3,501,305, 3,501,306, and 3,501,307, here incorporated by reference.

A-2. Speed Reduction

For some applications it is desirable to reduce speed to permit handling of the photographic materials under more visually favorable working conditions (e.g., handling in room light and/or in green or yellow light). Preferred hexacoordinated complexes for achieving this result in high chloride emulsions are those satisfying the formula:

$$[M^1(NO)(L^1)_5]^m \quad \text{(II)}$$

wherein m is zero, −1, −2, or −3, $M^1$ represents chromium, rhenium, ruthenium, osmium, or iridium, and $L^1$ represents one or a combination of halide and cyanide ligands or a combination of these ligands with up to two aquo ligands.

While any concentration of the complexes of Formula II can be employed which impart an observable speed reduction, to avoid excessive speed reductions it is generally preferred to employ the complexes of Formula II in concentrations of less than $1\times10^{-4}$ mole per silver mole. Specifically preferred concentrations are in the range of from $1\times10^{-9}$ to $5\times10^{-5}$ mole per silver mole. When thionitrosyl (NS) is substituted for nitrosyl (0) in Formula II significant reductions in photographic speed are also observed.

B. High Chloride Emulsions

The specific embodiments which follow under this heading all pertain specifically to high chloride silver halide emulsions. Such emulsions contain greater than 50 mole percent (preferably greater than 70 mole percent and optimally greater than 85 mole percent) chloride. The emulsions contain less than 5 mole percent (preferably less than 2 mole percent) iodide, with the balance, if any, of the halide being bromide.

B-1. Graphic Arts Emulsions

It has been discovered that, when a hexacoordinated complex containing at least one nitrosyl ligand and one of a selected group of transition metals is incorporated in high chloride silver halide grains a marked improvement (increase) in contrast can be realized. Preferred hexacoordinated complexes for this application are those satisfying Formula II. Preferred concentrations are in the range of from $2\times10^{-8}$ to $1\times10^{-4}$ mole per silver mole, optimally $2\times10^{-8}$ to $3\times10^{-5}$ mole per silver mole. For graphic arts applications the emulsions are monodispersed and preferably have a mean grain size of less than 0.7 μm, optimally less than 0.4 μm.

B-2. Reduced Low Intensity Reciprocity Failure

It has been observed that reduced low intensity reciprocity failure can be realized in high chloride emulsions which have been surface sensitized with gold and/or middle chalcogen (i.e., sulfur, selenium, and/or tellurium) and which contain an incorporated complex satisfying Formula II. Similar concentrations preferred for speed reduction in A-2 above are also preferred for reducing low intensity reciprocity failure.

B-3. Color Print Paper

Color print paper typically contains three color forming layer units, each including at least one radiation-sensitive silver halide emulsion and at least one agent capable of forming a subtractive primary imaging dye (for illustrations of couplers and other conventional dye image producing agents note *Research Disclosure*, Item 17643, cited above, section VII). The preferred high chloride emulsions preferred for use in forming color print paper are those in which bromide accounts for less than 20 mole percent of the total halide, Preferably less than 5 mole percent of the total halide, iodide accounts for less than 1 mole percent of the total halide, preferably iodide is present, if at all, in only trace amounts, and the balance of the halide is chloride.

When complexes satisfying Formula II are incorporated into the grains of color print paper emulsions as taught above in Sections A-2, B-1, and B-2, the same general kinds of effects described in those sections are realized.

EXAMPLES

The invention can be better appreciated by reference to the following specific examples:

EXAMPLE 1

A AgCl powder was made without the use of any peptizing agent such as gelatin in which the variation made was in the presence of $K_2Ru(NO)Cl_5$ as a dopant.

| | |
|---|---|
| Solution 1/1 | |
| Silver nitrate | 33.98 gms |
| Distilled water to total volume | 100 ml |
| Solution 2/1 | |
| Potassium chloride | 15.66 gms |
| Distilled water to total volume | 100 ml |

We have incorporated an anionic transition metal complex, $[Ru(NO)Cl_5]^{-2}$, into the AgCl lattice in the absence of gelatin by adding, in the dark, 100 ml of 2M $AgNO_3$ (Solution 1/1) through one delivery buret and 100 ml of 2.1M KCl (5% excess) (Solution 2/1)) through a second delivery buret into a common reaction vessel. The $[Ru(NO)Cl_5]^{-2}$ complex is usually added as the potassium salt. The reaction vessel initially contained 100 ml of water and was preheated to ca. 50° C. The reaction vessel was vigorously stirred during the $AgNO_3$ and KCl addition. The temperature in the reaction vessel fell a few degrees below 50° C. during the reaction due to the inrush of room temperature reactants. The addition was generally complete in ca. 6 to 7 minutes. The addition rate was controlled manually with the only criteria that the KCl buret addition b equal to or slightly ahead, but by no more than 1 milliliter, of the $AgNO_3$ addition. The dopant was added both through a third pipette or through the KCl solution without any noticeable difference occurring between the two addition methods. The dopant was added in a number of individual steps during the entire precipitation when added through a separate pipette and continuously during the entire precipitation when added through the KCl delivery buret along with the KCl. The samples were washed well with water, ca. 500 ml of water for each 0.2 moles of AgCl precipitated. The samples were then washed several times with approximately 50 ml of acetone each time and the acetone decanted after each washing, filtered using a #2 qualitative paper filter, washed with diethyl ether, and then stored in open glass dishes in the dark until dry.

Electron spin resonance (ESR) spectroscopy of a sample of $[Ru(NO)Cl_5]^{-2}$ doped into AgCl and exposed to 365 nm radiation gave an ESR spectrum, after cooling to a temperature of ca. 20° K., with measured g values of g'(perpendicular direction)=2.020±0.001 and g''(parallel direction)=1.933±0.001. A further splitting of 28.3±0.5 gauss due to $^{14}N$ (I=1, 99.63% natural abundance) was clearly resolved in the g region of the spectrum. This spectrum is very similar to an ESR spectrum that has been published in the literature for the paramagnetic $[Ru(NO)(2,2'\text{-bipyridine})_2Cl]^+$ complex produced by the electrochemical reduction of the $Ru(NO)(2,2'\text{-bipyridine})_2Cl]^{+2}$ complex (R. W. Callahan and T. J. Meyer, *Inorg. Chem.*, 16(3), 574 (1977). Both $[Ru(NO)(2,2'\text{-bipyridine})_2Cl]^{+2}$ and $Ru(NO)Cl_5]^{-2}$ have the 'Ru(NO)' unit in common. The observed ESR spectrum is also very similar to an ESR of the $[Fe(NO)(CN)_5]^{-3}$ center produced in an alkali halide lattice by electron trapping at a $[Fe(NO)(CN)_5]^{-2}$ center following a gamma radiation treatment (M. B. D. Bloom, J. B. Raynor, K. D. J. Root, and M. C. R. Symons, *J. Chem. Soc.* (A), 3212 (1971)). The magnitude of the nitrogen splitting observed in the g' region of the ESR spectrum of the light produced paramagnetic center in AgCl doped with $[Ru(NO)Cl_5]^{-2}$ indicates that the trapped photoproduced electron resides predominantly on the nitrogen atom of the nitrosyl ligand. This is completely consistent with a molecular orbital energy calculation by D. Guenzburger, A. Garnier, and J. Danon, *Inorganica Chimica Acts.*, 21, 119 (1977) that shows that the lowest unfilled molecular orbital for the $[Ru(NO)Cl_5]^{-2}$ complex into which an electron could go is almost totally on the nitrosyl part of the ruthenium complex. The ESR data show that 365 nm radiation of a AgCl sample containing incorporated $[Ru(NO)Cl_5]^{-2}$ centers produces paramagnetic $[Ru(NO)Cl_5]^{-3}$ centers due to electron trapping at the diagrammatic $[Ru(NO)Cl_5]^{-2}$ centers.

Multiscan Fourier Transform Infrared (FTIR) absorption measurements at 77° K. on a $[Ru(NO)Cl_5]^{-2}$ doped AgCl powder exhibited an infrared absorption band maximum at 1923 $cm^{-1}$ which is essentially identical to what is observed for the potassium salt of the ruthenium complex, $K_2Ru(NO)Cl_5$.

The $[Ru(NO)Cl_5]^{-2}$ complex is not prone to aquation and may be heated in water at 50° C. for several hours before aquation is observed to occur using optical absorption spectroscopy as a monitor of the stability of the complex. The $[Ru(NO)Cl_5]^{-2}$ complex has a characteristic optical adsorption spectrum as well as each aquated species in the series $[Ru(NO)Cl_{5-x}(H_2O)_x]^{-2}$ where x=1, 2, 3, 4, or 5 (E. E. Mercer, W. M. Campbell, and R. M. Wallace, *Inorg. Chem.*, 3(7), 1018 (1964)). The $Ru(NO)Cl_5{}^{-2}$ complex was added as a dopant to the AgCl precipitation in such a way that aquation would not be expected to be a problem. In addition, it was found that when specially prepared samples of $[Ru(NO)Cl_n(H_2O)]^-$(mono-aquated species) and $[Ru(NO)Cl_3(H_2]^0$ (di-aquated species) were used as dopants, results clearly indicated that the photochemically active center was the $[Ru(NO)Cl_5]^{-2}$ complex, as evidenced by the formation of paramagnetic $[Ru(NO)Cl_5]^{-3}$, as observed by ESR. If the dopant levels were held constant for the three dopants, $[Ru(NO)Cl_5]^{-2}$, $[Ru(NO)Cl_4(H_2O)]^{-1}$, and $[Ru(NO)Cl_3(H_2O)_2]^0$, the amount of $[Ru(NO)Cl_5]^{-3}$ observed by ESR when $[Ru(NO)Cl_4(H_2O)]^{-1}$ was added was approximately the same as when the pentachloro complex $[Ru(NO)Cl_5]^{-2}$ was added but only about 10% of the pentachloro complex $[Ru(NO)Cl_5]^{-2}$ level when $[Ru(NO)Cl_3(H_2O)_2]$ was used. Both $[Ru(NO)Cl_4(H_2O)]^{-1}$ and $[Ru(NO)Cl_3(H_2O)_2]^0$ react with $Cl^{-0}$ ions to produce $[Ru(NO)Cl_5]^{-2}$ but $[Ru(NO)Cl_3(H_2O)_2]^0$ does so less rapidly than $[Ru(NO)_4(H_2O)]^{-1}$.

Gelatin does not show any tendency to promote aquation or loss of the nitrosyl group for $[Ru(NO)Cl_5]^{-2}$ in a 0.5% gelatin solution for periods of up to two days at 30° C. as monitored by optical absorption spectroscopy.

The $[Ru(NO)Cl_5]^{-2}$ complex itself is photochemically reactive in aqueous solution with nitrosyl ligand loss to produce the $[RuCl_5(H_2O)]^{-2}$ complex [A. B. Nikol'skii, A. M. Popov, and I. V. Vasilevskii, *Koord. Khim.*, 2(5), 671 (1976), and A. B. Nikol'skii and A. M. Popov, *Doklady Akad. Nauk SSSR*, 250(4), 902 (1980)]. Even though the quantum efficiency for NO loss is very low, precautions were always taken to prevent any photochemical degradation of the $[Ru(NO)Cl_5]^{-2}$ complex. The ruthenium oxidation state in the $[RuCl_5(H_2O)]^{-2}$ complex is +3 and when incorporated into the AgCl lattice during AgCl precipitation, ESR indicates that a paramagnetic Ru(+3) center is present even without exposure. Loss of NO ligand completely alters the structure and the photochemical behavior of the complex when incorporated into AgCl.

All of the above observations are quite conclusive evidence that, indeed, the $[Ru(NO)Cl_5]^{-2}$ complex has been incorporated into the AgCl lattice with retention of the nitrosyl (NO) ligand. Any loss of the nitrosyl during the AgCl precipitation to produce non nitrosyl complexes such as $[RuCl_6]^{-3}$ or $[RuCl_5(H_2)]^{-2}$ would cause oxidation of the ruthenium +2 oxidation state in $[Ru(NO)Cl_5]^{-2}$ to a +3 oxidation state in the $[RuCl_6]^{-3}$ or the $[RuCl_5(H_2O)]^{-2}$ complexes. These last two mentioned complexes are paramagnetic as such and when incorporated into the AgCl lattice are observable by ESR even before exposure. Also deliberate doping with $[RuCl_6]^{-3}$ does not produce anything similar to what one obtains when the dopant is $[Ru(NO)Cl_5]^{-2}$. For example, the ESR results for $[RuCl_6]^{-3}$ in AgCl [D. A. Corrigan, R. S. Eachus, R. E. Graves, and M. T. Olm, *J. Chem. Phys.*, 70(12), 5676 (1979)] are quite different than those for $[Ru(NO)Cl_5]^{-2}$ in AgCl.

Ruthenium analysis using ion coupled plasma/atomic emission spectroscopy shows that when the $[Ru(NO)Cl_5]^{-2}$ dopant is added during the AgCl precipitation, the metal ion Ru is incorporated into the powders with an efficiency of ca. 100%.

The control AgCl powder without the dopant $[Ru(NO)Cl_5]^{-2}$ did not show under any conditions any ESR spectra due to a ruthenium center of any sort, any nitrosyl infrared adsorptions, nor any ruthenium by ion coupled plasma/atomic emission spectroscopy.

EXAMPLE 2

The $[Os(NO)Cl_5]^{-2}$ anionic coordination complex was incorporated into a silver chloride powder in the absence of a peptizing agent such as gelatin using the same procedure as described in Example 1 starting with each of the potassium and cesium salts of the coordination complex. Exposure of an $[Os(NO)Cl_5]^{-2}$ doped AgCl sample to 365 nm radiation produced a paramagnetic center that was observable using ESR after cooling the exposed sample to ca. 20° K. The measured g values for the paramagnetic center were $g'=1.918\pm0.003$ and $g''=1.706\pm0.001$. Although spectral splittings in the g' region were not as clearly resolved as for the analogous ruthenium center in Example 1, the ESR spectra provided evidence that the light exposure had produced a center in which an unpaired electron was predominantly on a nitrogen atom. By analogy to Example 1 and to the literature references in Example 1, the center produced in Example 2 is $[Os(NO)Cl_5]^{-3}$ produced by electron trapping at an $[Os(NO)Cl_5]^{-2}$ center.

The control AgCl powder without the $[Os(NO)Cl_5]^{-2}$ dopant did not show any ESR spectra, under any conditions, similar to the ESR spectra produced in the presence of the $[Os(NO)Cl_5]^{-2}$ dopant.

EXAMPLE 3

A AgCl powder sample was prepared as described in Example 1 except that both $K_2Ru(NO)Cl_5$ and $K_4Os(CN)_6$ were used to co-dope the same sample. ESR of this sample, after exposure to 365 nm radiation, showed that the $[Ru(NO)Cl_5]^{-2}$ centers were trapping electrons to produce $[Ru(NO)Cl_5]^{-3}$ centers and that the $[Os(CN)_6]^{-4}$ centers were trapping holes to produce $[Os(CN)_6]^{-3}$ centers. The two centers were not competing for the same electronic species, the photoproduced electron or the photoproduced hole. This is completely consistent with Example 1.

EXAMPLE 4

Emulsion 1 0.55 μm Undoped AgCl (Control)

At 46° C., 240 g of gelatin were added to a reaction vessel containing 6 liters of water along with 1.2 g of a thioether silver halide ripening agent of the type disclosed in McBride U.S. Pat. No. 3,271,157. The chloride concentration was adjusted to 0.041 molar. Concentrated aqueous silver nitrate was introduced into the vigorous stirred gelatin solution along with sufficient aqueous sodium chloride to maintain the stated concentration of halide ion. Sufficient material was added to make 8 moles of approximately 0.55 μm mean edge length silver chloride cubic grains.

After washing, a portion of the emulsion was gold sensitized and prepared for coating by addition of extra gelatin and spreading agent. Coatings on cellulose acetate film support were exposed through a step tablet to 365 nm radiation and processed for 12 minutes in a hydroquinone Elone® developer. After fixing and washing the coating, photographic speed was measured at a density of 0.15 above fog. A contrast of 3.5 was measured.

Emulsion 2 0.55 μm $[Os(NO)Cl_5]^{-2}$ Doped AgCl (Example)

The procedure described above in connection with Emulsion 1 was repeated, except that a second halide solution containing $Cs_2Os(NO)Cl_5$ (0.075 mg, giving $1.4\times10^{-8}$ mole/final Ag mole) was added concurrently with addition of 1 percent of the silver nitrate, starting after 13 percent of the silver nitrate had been introduced.

A reduction in photographic speed was observed, but contrast was increased to 4.6.

Emulsion 3 0.5 μm $[Os(NO)Br_5]^{-2}$ Doped AgCl (Example)

The procedure described in connection with Emulsion 2 was repeated, except that the second halide solution containing 1.0 mg per mole of $K_2Os(NO)Br_5$ was added concurrently with the addition of 1% of the silver nitrate, starting after 13% of the silver nitrate was added. This resulted in a dopant concentration in the reaction vessel of $1.4\times10^{-6}$ mole per final silver mole.

This emulsion was coated without chemical or spectral sensitization and compared to a coating of a control emulsion differing only by the omission of the osmium nitrosyl pentabromide coordination complex.

A reduction in photographic speed was observed for Emulsion 3 as compared to that of the control emulsion. There was additionally an advantageous reduction in contrast in Emulsion 3 as compared to the control emulsion, from 4.4 to 2.5.

Emulsion 4 0.5 μm $[Os(NO)I_5]^{-2}$ Doped AgCl (Example)

The procedure described in connection with emulsion 2 was repeated, except that the second halide solution containing 1.35 mg per mole of $K_2Os(NO)I_5$ was added concurrently with the addition of 1% of the silver nitrate, starting after 13% of the silver nitrate was added. This resulted in a dopant concentration in the reaction vessel of $1.45\times10^{-6}$ mole per final silver mole.

A reduction in photographic speed was observed for Emulsion 4 as compared to that of the control emulsion. There was additionally an advantageous reduction in contrast in Emulsion 4 as compared to the control emulsion, from 4.4 to 2.9.

Emulsion 5

The procedure described in connection with control Emulsion 1 was repeated, except that a third aqueous solution containing 8.06 mg ($2.5\times10^{-5}$ mole) $K_2Ru(NO)F_5.H_2O$ per final silver mole was added currently with the silver nitrate solution. The third aqueous solution was added starting after 13 percent of the silver nitrate was added and finished when approximately 75 percent of the silver nitrate was added.

Emulsion 5 was sulfur and gold sensitized and compared to a similarly sensitized coating of control Emulsion 1. A reduction in photographic speed was observed as well as an advantageous increase in contrast from 2.2 to 2.8.

Emulsion 6 0.5 μm $K_2Os(NS)Cl_5$ Doped AgCl (Example)

The procedure described in connection with Emulsion 1 was repeated, except that a third aqueous solution containing 12.3 mg or $2.5\times10^{-5}$ mole $K_2Os(NS)Cl_5$ per final silver mole was added concurrently with the silver nitrate solution. Introduction of the third aqueous solution was begun after 13 percent of the silver nitrate was added and ended when approximately 75 percent of the silver nitrate was added.

An unsensitized portions of Emulsions 1 and 6 were similarly coated, exposed, and processed. An advantageous reduction in photographic speed was exhibited by Emulsion 6 as compared to the Emulsion 1 control.

EXAMPLE 5

This example illustrates a series of emulsions that were prepared in which variations in the concentration of $K_2Ru(NO)Cl_5$ were compared photographically to both a non nitrosyl containing complex ($K_2RuCl_6$) and an undoped control.

The undoped 0.27 μm silver chlorobromo iodide control emulsion $AgCl_{90}Br_9I_1$ was

| Solution A (Reaction Vessel) | | Solution C (Silver) | |
|---|---|---|---|
| Bone Gelatin | 50.0 g | $AgNO_3$ | 170.0 g |

-continued

| | | | |
|---|---|---|---|
| NaCl | 2.0 g | D. W. | 682.0 ml |
| KI | 1.7 g | 2N $H_2SO_4$ | 0.8 cc |
| D. W. | 1050.0 ml | Temperature | 45.0° C. |
| Temperature | 68.0° C. | | |
| pH ($H_2SO_4$) | 2.95 | | |
| Solution B (Salts) | | Solution D (Gel) | |
| NaCl | 57.9 g | Bone Gelatin | 48.6 g |
| KBr | 10.7 g | D. W. | 400.0 ml |
| D. W. | 297.0 cc | | |
| Temperature | 32.0° C. | | |
| | | Solution E (Coag.) | |
| | | $Na_2SO_4$ | 131.0 g |
| | | D. W. | 404.0 ml |
| | | Temperature | 43.0° C. |

D. W. = Distilled Water

Solution B was added at a constant flowrate (51.2 cc/min) to a well stirred reaction vessel containing solution A. Five seconds after the start of solution B, solution C was added to the reaction vessel at a constant flowrate (113.7 cc/min). Total run time for solution B was 6.0 minutes, whereas solution C run was completed in 6.3 minutes. The emulsion was held at 68° C. for 11 minutes and then cooled to 30° C. Solution E was added to the emulsion and settling of the coagulum occurred within 30 minutes after which the remaining liquid was decanted. The coagulum, upon addition of solution D, was redispersed at 40° C., chill, set, noodled, and washed. The redispersed emulsion was adjusted for pH (4.5) and pAg (6.0) and was heat treated (62° C., 5 minutes) in the presence of 1.1 mg $Na_2S_2O_3.5H_2O$/mole Ag and 2.6 mg $KAuCl_4$/mole Ag. Coatings were prepared containing 1.0 g of 4-hydroxy-6-methyl-1,3,3a,7-tetraazaindene/mole Ag, and 1.84 g of formaldehyde/mole Ag. Five doped emulsions were also prepared and coated, as described above, containing either $K_2Ru(NO)Cl_5$ or $K_2RuCl_6$ which were added 5 minutes after the start of precipitation for 30 seconds from a water solution (0.025 mg dopant/cc D.W.). All coated samples were exposed at $10^{-3}$ seconds on an EG&G TM sensitometer containing Wratten® filters 36, 39, and 38A and developed for 30 seconds in a hydroquinone pH 10.5 developer at 37.8° C. using a Kodamatic 17® processor.

The sensitometric results (Table 11) shows that the nitrosyl containing ruthenium complex ($K_2Ru(NO)Cl_5$) produces a highly desirable contrast increase and speed decrease as a function of concentration whereas the non nitrosyl ruthenium complex ($K_2RuCl_6$) shows little change in either speed or contrast when both complexes are compared to the undoped control.

TABLE II

| Dopant | Concentration (mole dopant/mole Ag) | Contrast* | Relative Blue Speed** |
|---|---|---|---|
| None | 0 | 5.59 | 204 |
| $K_2Ru(NO)Cl_5$ | $6.4\times10^{-8}$ | 7.17 | 190 |
| $K_2Ru(NO)Cl_5$ | $12.9\times10^{-8}$ | 7.64 | 149 |
| $K_2Ru(NO)Cl_5$ | $19.3\times10^{-8}$ | 8.03 | 141 |
| $K_2Ru(NO)Cl_5$ | $25.7\times10^{-8}$ | 8.56 | 114 |
| $K_2RuCl_6$ | $19.3\times10^{-8}$ | 6.16 | 218 |

*Measured at 1.0 to 3.0 density above D-Min
**Measured at 1.0 density above D-Min.

EXAMPLE 6

A series of monodisperse silver chloride emulsions were prepared in which the variation made was in the presence and level of $K_2Ru(NO)Cl_5$.

Control Emulsion IA was made in the absence of $K_2Ru(NO)Cl_5$ according to the following directions:

Three solutions were prepared of the following compositions:

| | |
|---|---|
| Solution 1 | |
| Gelatin | 240 g |
| D. W. | 6000 mL |
| Solution 2 | |
| Sodium chloride | 584 g |
| D. W. to total volume | 5000 mL |
| Solution 3 | |
| Silver nitrate | 1360 g |
| D. W. | 2640 mL |
| Dissolved at 40° C. | |
| D. W. to total volume | 4000 mL |
| Dissolved at 40° C. | |

Solution 1 was placed in a reaction vessel maintained at 46° C. To Solution 1 was added 0.6 g of a thioether silver halide ripening agent of the type disclosed in McBride U.S. Pat. No. 3,271,157. The PAg of the solution was then adjusted to 7.6 with Solution 2. Solutions 2 and 3 were then simultaneously run into Solution 1 over a 15 minute period, maintaining the pAg at 7.6. Following the precipitation the mixture was cooled to 38° C. and washed by ultrafiltration as described in *Research Disclosure*, Vol. 102, October 1972, Item 10208. At the end of the washing period, the emulsion concentration was adjusted to a weight below 2000 g per mole of silver containing 60 g of gelatin per mole of silver. The mean Srain size was 0.26 μm.

Example Emulsion 1B was prepared similarly as Control Emulsion 1A, except that after 2 minutes of simultaneous running of Solutions 2 and 3, 2.3 mL of Solution 4 was injected through a syringe into the line delivering Solution 2 to the reaction vessel.

Solution 4 was prepared by dissolving $K_2Ru(NO)Cl_5$ in a solution identical to Solution 2 in an amount sufficient to give 100 micrograms $K_2Ru(NO)Cl_5$ per final mole of silver or $2.6\times10^{-7}$ mole per final silver mole in the reaction vessel.

The silver chloride emulsions prepared as described above were given a conventional gold chemical sensitization and green spectral sensitization and coated with a dye forming coupler dispersion on a photographic paper base at square meter coverages of 280 mg Ag, 430 mg coupler, and 1.66 g gelatin. The coated elements were then exposed through a graduated density step wedge at times ranging from 0.5 to 100 seconds, with suitable neutral density filters added to maintain constant total exposure. The coatings were processed in a color print developer.

In Table III the speed of each coating at 0.5 second exposure is measured at a reflection density of 1.0 and taken as a reference with a value of 100. The relative speed at 100 seconds exposure time is taken as a measure of the reciprocity failure, with a speed of 100 indicating a desirable condition of no failure in reciprocity. As a measure of contrast reciprocity a density is measured for 0.5 second exposure at a point representing 0.3 log E or a factor of 2 less exposure than that needed to achieve a density of 1.0. The change in this toe density or "delta toe" is recorded when exposure time is increased to 100 seconds. A similar density is measured with 0.5 second exposure at a point representing a factor of 2 more exposure than needed to achieve a density of 1.0. The change in this higher exposure response or "delta shoulder" when the exposure time is increased to 100 seconds is also a measure of contrast change with exposure time. The desirable invariant contrast corresponds to a "delta shoulder" of 0.0.

TABLE III

| Emulsion | Speed 0.5 sec | Speed 100 sec | Δ Toe | Δ Shoulder |
|---|---|---|---|---|
| 1A (Control) | 100 | 74 | −0.03 | +0.09 |
| 1B (Example) | 100 | 102 | −0.01 | 0.00 |

Table III shows that the presence of the $K_2Ru(NO)Cl_5$ significantly reduces the change in speed and contrast with exposure time in the magenta record of a color paper.

EXAMPLE 7

Control Emulsion 1C was prepared in a manner similar to Control Emulsion 1A, except that the reaction vessel temperature was 75° C.

Example Emulsion 1D was prepared in a manner similar to Example Emulsion 1B, except that the reaction vessel temperature was 75° C. and the amount of $K_2Ru(NO)Cl_5$ added was sufficient to give 25 micrograms per final mole of silver or $6.5\times10^{-8}$ mole per Ag mole.

Emulsions 1C and 1D were sensitized and coated similarly as Emulsions 1A and 1B, except that the silver coverage was reduced to 183 mg/m$^2$ and the emulsions were sensitized to the red rather than the green portion of the spectrum. Emulsions 1C and 1D were exposed and processed similarly as Emulsions 1A and 1B. The results are summarized in Table IV.

TABLE IV

| Emulsion | Speed 0.5 sec | Speed 100 sec | Δ Toe | Δ Shoulder |
|---|---|---|---|---|
| 1C (Control) | 100 | 78 | +0.05 | −0.05 |
| 1D (Example) | 100 | 105 | −0.04 | +0.06 |

Table IV shows that the presence of the $K_2Ru(NO)Cl_5$ significantly reduces the change in speed with exposure time in the cyan record of a color paper.

EXAMPLE 8

Control Emulsion 1E was prepared in a manner similar to that for Control Emulsion 1A, except that the thioether ripener level was 1.2 grams.

Example Emulsion 1F was prepared in a manner similar to that for Example Emulsion 1B, except that the thioether ripener level of 1.2 g and the $K_2Ru(NO)Cl_5$ level was sufficient to give 10 micrograms per final silver mole or $2.6\times10^{-8}$ mole per silver mole.

Example Emulsion 1G was prepared in a manner similar to that for Example Emulsion 1F, except that Solution 4 contained $Cs_2Os(NO)Cl_5$ in an amount sufficient to give 9.4 micrograms per final silver mole or $1.42\times10^{-8}$ mole per silver mole.

Emulsions 1E, 1F, and 1G were sensitized, coated, and tested in the same manner as Emulsions 1C and 1D. The results are summarized in Table V.

TABLE V

| Emulsion | Speed 0.5 sec | Speed 100 sec | Δ Toe | Δ Shoulder |
|---|---|---|---|---|
| 1E (Control) | 100 | 58 | +0.117 | −0.148 |
| 1F (Example) | 100 | 83 | −0.004 | −0.095 |
| 1G (Example) | 100 | 91 | −0.040 | −0.169 |

Table V shows reductions in both speed and contrast changes for the example emulsions containing $K_2Ru(NO)Cl_5$ or $Cs_2Os(NO)Cl_5$.

EXAMPLE 9

A procedure similar to that described in Example 6 was employed to prepare an emulsion with $2.6\times10^{-8}$ mole of $K_2Os(NO)Cl_5$ being added per silver mole. Analysis indicated that $1.8\times10^{-8}$ mole $[Os(NO)Cl_5]^{-2}$ was incorporated in the grain per mole of silver. Increased toe contrast and reduced low intensity contrast reciprocity failure were observed.

EXAMPLE 10

A procedure similar to that described in Example 9 was employed, except that a concentration of $Cs_2Os(NO)Cl_5$ of $8.7\times10^{-8}$ mole of per silver mole was employed. Similar photographic effects were observed.

EXAMPLE 11

A procedure similar to that described in Example 6 was employed to prepare an emulsion with $1.3\times10^{-7}$ mole of $Cs_2Re(NO)Cl_5$ being added per silver mole. Analysis indicated that $4.7\times10^{-8}$ mole $[Re(NO)Cl_5]^{-2}$ was incorporated in the grain per mole of silver. Increased toe contrast and reduced low intensity contrast reciprocity failure were observed.

EXAMPLE 12

A procedure similar to that described in Example 11 was employed, except that $Cs_2Re(NO)Cl_5$ was replaced with a like amount of $K_2Ir(NO)Cl_5$. Similar photographic response was observed.

EXAMPLE 13

Procedures similar to those described in Example 6 were employed to prepare emulsions, with from $2.6\times10^{-8}$ to $6\times10^{-7}$ mole of $K_2Ru(NO)Br_5$. Low intensity contrast reciprocity failure reduction was observed to be produced by introduction of the hexacoordination complex during precipitation. Analysis indicated that 87 percent of the $[Ru(NO)Br_5]^{-2}$ was incorporated in the grain.

EXAMPLE 14

Example 13 was repeated, but with $K_2Ru(NO)I_5$ being substituted for $K_2Ru(NO)Br_5$. Introduction of the complex partially desensitized the emulsion.

EXAMPLE 15

A Procedure similar to that described in Example 6 was employed to prepare an emulsion with $2.5\times10^{-5}$ mole $K_2Ru(NO)Cl_5$ per silver mole in the reaction vessel. This emulsion was reduction and gold fogged using thiourea dioxide and potassium chloroaurate as described in Illingsworth U.S. Pat. No. 3,501,307. With no additional desensitizer, a coating of this emulsion was exposed for 10 seconds to 365 nm radiation through a step wedge and processed for 3 minutes in a hydroquinone-Elon® (N-methyl-p-amino-phenol hemisulfate) developer. Unexposed areas exhibited a maximum density of 1.4 while exposure produces a desirable minimum density of 0.08.

EXAMPLE 16

A series of silver bromide octahedral emulsions of 0.45 μm average edge length were prepared, differing in the hexacoordinated transition metal complex incorporated in the grains.

Control 16A was made with no transition metal complex present according to the following procedure:

Six solutions were prepared as follows:

| | |
|---|---|
| **Solution 1(16)** | |
| Gelatin (bone) | 50 gm |
| D. W. | 2000 mL |
| **Solution 2(16)** | |
| Sodium bromide | 10 gm |
| D. W. | 100 mL |
| **Solution 3(16)** | |
| Sodium bromide | 412 gm |
| D. W. to total volume | 1600 mL |
| **Solution 4(16)** | |
| Silver nitrate (5 Molar) | 800 mL |
| D. W. to total volume | 1600 mL |
| **Solution 5(16)** | |
| Gelatin (phthalated) | 50 gm |
| D. W. | 300 mL |
| **Solution 6(16)** | |
| Gelatin (bone) | 130 gm |
| D. W. | 400 mL |

Solution 1(16) was adjusted to a PH of 3.0 with nitric acid at 40° C. The temperature of solution 1(16) was adjusted to a 70° C. Solution 1(16) was then adjusted to a pAg of 8.2 with solution 2(16). Solutions 3(16) and 4(16) were simultaneously run into the adjusted solution 1(16) at a constant rate for the first 4 minutes with introduction being accelerated for the next 40 minutes. The addition rate was then maintained over a final 2 minute period for a total addition time of 46 minutes. The pAg was maintained at 8.2 over the entire run. After the addition of solutions 3(16) and 4(16), the temperature was adjusted to 40° C., the pH was adjusted to 4.5, and solution 5(16) was added. The mixture was then held for 5 minutes, after which the pH was adjusted to 3.0 and the gel allowed to settle. At the same time the temperature was dropped to 15° C. before decanting the liquid layer. The depleted volume was restored with distilled water. The pH was readjusted to 4.5, and the mixture held at 40° C. for ½ hour before the pH was adjusted to 3.0 and the settling and decanting steps were repeated. Solution 6(16) was added, and the pH and pAg were adjusted to 5.6 and 8.2, respectively. The emulsion was digested with 1.5 mg per Ag mole of $Na_2S_2O_3.5H_2O$ and 2 mg per Ag mole $KAuCl_4$ for 40 minutes at 70° C. Coatings were made at 27 mg Ag/dm$^2$ and 86 mg gelatin/dm$^2$. The samples were exposed to 365 nm radiation for 0.01, 0.1, 1.0, and 10.0 seconds and developed for 6 minutes in a hydroquinone-Elon (N® p-methyl-aminophenol hemisulfate) developer.

Control 16A' was prepared identically to Control Emulsion 16A. This emulsion was included to indicate batch to batch variances in emulsion performance. Emulsion 16A' was digested in the same manner as Control 16A.

Examples 16B, 16C, and 16D were prepared similarly as Control 16A, except that Solutions 1(TMC), 2(TMC) or 3(TMC) were added after the first four minute nucleation period and during the 35 minutes of the growth period into the Solution 3(16). Some of Solution 3(16) was kept in reserve and was the source of transition metal complex free sodium bromide added during the last 7 minutes of the preparation. These emulsions were digested in the same manner as Emulsion 16A.

Solutions 1(TMC), 2(TMC), or 3(TMC) were prepared by dissolving 0.26 to 66 mgs of $Cs_2Os(NO)Cl_5$ (see Table VI) in that part of Solution 3(16) that was added during the 35 minutes of the growth period of Control 16A. The incorporated transition metal complex functions as an effective electron trap, as demonstrated by the decreased surface speed shown in Table VI.

Examples 16E, 16F, 16G, and 16H were prepared similarly as Control 16A, except that Solutions 4(TMC), 5A(TMC), 6(TMC), or 7(TMC) were added to Solution 3(16) after the first four minute nucleation period and during the first 35 minutes of the growth period. Some of Solution 3(18) was kept in reserve and was the source of dopant free sodium bromide added during the last 7 minutes of the preparation. These emulsions were digested in the same manner as Emulsion 16A.

Solutions 4(TMC), 5(TMC), 6(TMC), or 7(TMC) were prepared by dissolving 0.076 to 39 mg of $K_2Ru(NO)Cl_5$ (see Table VI) in that part of Solution 3(16) that was added during the 38 to 40 minute growth period of Control 16A. The incorporated transition metal complex functions as an effective electron trap, as demonstrated by the decreased surface speed shown in Table VI.

Examples 16I and 16J were prepared similarly as Control 16A, except that Solution 8(TMC) or 9(TMC) were added after the first four minute nucleation period and during the first 35 minutes of the growth period into the Solution 3(16). Some of Solution 3(16) was kept in reserve and was the source of transition metal complex free sodium bromide added during the last 7 minutes of the preparation. The emulsions were digested in the same ways as Emulsion 16A.

Solutions 8(TMC) and 9(TMC) were prepared by dissolving 0.26 and 66 mg, respectively, of $Cs_2Re(NO)Cl_5$ (see Table VI) in that part of Solution 3(16) that was added during the 38 to 40 minute growth period of Control 16A. The incorporated transition metal complex functions as an effective electron trap, as demonstrated by the decreased surface speed shown in Table VI.

Examples 16K and 16L were prepared similarly as Control 16A, except that Solutions 10(TMC) and 11(TMC) were added to Solution 3(16) after the first four minute nucleation period and during the first 35 minutes of the growth period. Some of Solution 3(16) was kept in reserve and was the source of transition metal complex free sodium bromide added during the last 7 minutes of the preparation. These emulsions were digested in the same way as Emulsion 16A.

Solutions 10(TMC) and 11(TMC) were prepared by dissolving 0.28 mg and 70 mg, respectively, of $K_2Os(NO)Br_5$ (see Table VI) in that part of Solution 3(16) that was added during the first 35 minutes of the minute growth period of Control 16A. The incorporated transition metal complex functions as an effective electron trap, as demonstrated by the decreased surface speed shown in Table VI.

Example 16M was prepared similarly as Control 16A, except that Solution 12(TMC) was added to Solution 3(16) after the first four minute nucleation period and during the first 35 minutes of the growth period. Some of Solution 3(16) was kept in reserve and was the source of transition metal complex free sodium bromide added during the last 7 minutes of the preparation. The emulsion was digested in the same manner as Emulsion 16A.

Solution 12(TMC) was prepared by dissolving 84 mg of $K_2Ru(NO)I_5$ (see Table VI) in that part of Solution 3(16) that was added during the first 35 minutes of the growth period of Control 20A. The incorporation transition metal complex functions as an effective electron trap, as demonstrated by the decreased surface speed shown in Table VI.

TABLE VI

| | Transition Metal Complex | | Relative |
|---|---|---|---|
| Ex/Cont | Formula | Micromole/Ag Mole | Speed |
| 16A | — | — | 100 |
| 16A' | — | — | 100 |
| 16B | $Cs_2Os(NO)Cl_5$ | 25 | <1 |
| 16C | $Cs_2Os(NO)Cl_5$ | 0.5 | 2 |
| 16D | $Cs_2Os(NO)Cl_5$ | 0.1 | 15 |
| 16E | $K_2Ru(NO)Cl_5$ | 25 | <1 |
| 16F | $K_2Ru(NO)Cl_5$ | 0.5 | 1 |
| 16G | $K_2Ru(NO)Cl_5$ | 0.1 | 4 |
| 16H | $K_2Ru(NO)Cl_5$ | 0.04 | 36 |
| 16I | $Cs_2Re(NO)Cl_5$ | 0.1 | 70 |
| 16J | $Cs_2Re(NO)Cl_5$ | 1 | 22 |
| 16K | $K_2Os(NO)Br_5$ | 0.1 | 6 |
| 16L | $K_2Os(NO)Br_5$ | 25 | <1 |
| 16M | $K_2Ru(NO)I_5$ | 25 | <1 |

EXAMPLE 17

This example illustrates a series of emulsions doped with various transition metal complexes containing a nitrosyl ligand which were compared photographically to an undoped control emulsion.

The undoped 0.15 μm silver chloride control emulsion was precipitated in the following manner.

| | |
|---|---|
| Solution A (Reaction Vessel) | |
| Bone Gelatin | 40.0 g |
| D. W. | 666.0 ml |
| Temperature | 40.6° C. |
| pH ($H_2SO_4$) | 3.0 |
| Solution B (Salts) | |
| NaCl | 66.6 g |
| D. W. | 317.2 cc |
| Temperature | 40.6° C. |
| Solution C (Silver) | |
| $AgNO_3$ | 170.0 g |
| D. W. | 301.3 ml |
| Temperature | 30.8° C. |

D. W. = Distilled Water

Solutions B and C were added simultaneously at constant flow rates (B=20.3 ml/min, C=22.3 ml/min) to a well stirred reaction vessel containing Solution A. Total run time for Solutions B and C was 15 minutes. The emulsion precipitation was controlled at a pAg of 7.4. At the end of the precipitation, the emulsion was adjusted to a pH of 4.5 and was ultrafiltered at 40.6° C. for 30 to 40 minutes to a pAg of 6.2. The emulsion was chill set. Coatings were prepared containing 1.0 g of 4-hydroxy 6-methyl 1,3,3a, 7-tetraazaindene/mole Ag, and 5.0 g of bis(vinylsulfonyl)methane/mole Ag. The silver and gel coverages of the coatings were 3.3 g $Ag/m^2$ and 2.7 $gel/m^2$.

Seven doped emulsions were also prepared and coated, as described above, differing only by addition of the dopants indicated below in Table VII. Dopants were added 30 seconds after the start of the precipitation for 30 seconds from a water solution (1.0 mg dopant/ml D.W.). All coated samples were exposed using a metal halide light source and developed for 35 seconds in a hydroquinone-(hydroxy-methyl 4-methyl-1-phenyl-3-pyrazolidone) developer, pH 10.4, at 35° C. using an LD-220 QT Dainippon TM screen processor.

The sensitometric results summarized in Table VII show that the nitrosyl containing complexes produce a highly desirable contrast increase and speed decrease as compared to the undoped control emulsion.

TABLE VII

| Dopant | Concentration (mole dopant/ mole Ag) | Contrast* | Relative UV Speed** |
|---|---|---|---|
| None | 0 | 3.3 | 328 |
| $K_2Ru(NO)Cl_5$ | $1.25 \times 10^{-6}$ | 5.1 | 279 |
| $K_2Ru(NO)Br_5$ | $1.25 \times 10^{-6}$ | 5.2 | 291 |
| $K_2Ru(NO)I_5$ | $2.50 \times 10^{-6}$ | 4.9 | 301 |
| $K_2Os(NO)Cl_5$ | $5.00 \times 10^{-6}$ | 5.5 | 268 |
| $K_2Os(NO)Br_5$ | $1.25 \times 10^{-6}$ | 4.5 | 310 |
| $K_3Cr(NO)(CN)_5$ | $1.00 \times 10^{-5}$ | 4.4 | 283 |
| $Cs_2Re(NO)Cl_5$ | $5.00 \times 10^{-6}$ | 5.6 | 310 |

*Measured at 0.1 to 2.5 density above D-Min
**Measured at 0.1 density above D-Min. The invention has been described in detail The invention has been described in detail with particular reference to preferred embodiments thereof, but it will be understood that variations and modifications can be effected within the spirit and scope of the invention.

What is claimed is:

1. A photographic silver halide emulsion comprised of radiation-sensitive silver halide grains exhibiting a face centered cubic crystal lattice structure internally containing a nitrosyl or thionitrosyl coordination ligand and a transition metal chosen from groups 5 to 10 inclusive of the periodic table of elements.

2. A photographic emulsion according to claim 1 further characterized in that said crystal lattice contains a nitrosyl ligand.

3. A photographic emulsion according to claim 1 further characterized in that said emulsion contains a hexacoordination complex of a transition metal chosen from groups 5 to 10 inclusive of the periodic table of elements containing at least one nitrosyl or thionitrosyl ligand.

4. A photographic emulsion according to claim 3 further characterized in that said hexacoordination complex satisfies the formula:

$$[ML_4(NY)L']^n$$

where

M is a transition metal chosen from groups 5 to 10 inclusive of the periodic table of elements;

L is a bridging ligand;

L' is L or (NY);

Y is oxygen or sulfur; and n is zero, −1, −2, or −3.

5. A photographic emulsion according to claim 4 further characterized in that said emulsion is a direct positive emulsion in which the silver halide grains are surface fogged and the transition metal complex is present in the surface fogged silver halide grains in a concentration sufficient to internally trap photogenerated electrons.

6. A direct positive photographic emulsion according to claim 5 further characterized in that said emulsion contains from about $10^{-8}$ to $10^{-3}$ mole per silver mole of the transition metal complex.

7. A direct positive photographic emulsion according to claim 6 further characterized in the emulsion contains from about $10^{-6}$ to $10^{-4}$ mole per silver mole of the transition metal complex.

8. A photographic emulsion according to claim 4 further characterized in that M is a group 8 to 10 inclusive heavy transition metal.

9. A photographic emulsion according to claim 4 further characterized in that M is a group 5 to 7 inclusive light transition metal.

10. A photographic emulsion according to claim 4 further characterized in that said hexacoordination complex satisfies the formula:

$$[M^1(NO)(L^1)_5]^m$$

wherein m is zero, −1, −2, or −3, $M^1$ represents chromium, rhenium, ruthenium, osmium, or iridium, and $L^1$ represents one or a combination of halide and cyanide ligands or a combination of these ligands with up to two aquo ligands.

11. A photographic emulsion according to claim 10 further characterized in that said silver halide grains contain at least 50 mole percent chloride and less than 5 mole percent iodide, based on total silver, with any residual halide being bromide.

12. A photographic emulsion according to claim 11 Further characterized in that said emulsion is a color print emulsion which contains at least 70 mole percent chloride and less than 2 mole percent iodide, based on total silver.

13. A photographic emulsion according to claim 12 further characterized in that $M^1$ is a transition metal chosen from the class consisting of rhenium, ruthenium, and osmium and $L^1$ is halide.

14. A photographic emulsion according to claim 11 further characterized in that the emulsion is a monodispersed emulsion having a mean grain size of less than 0.7 μm and containing the transition metal complex in an amount sufficient to increase contrast.

15. A photographic emulsion according to claim 14 further characterized in that the transition metal complex is present in a concentration of from $2\times10^{-8}$ to $1\times10^{-4}$ mole per silver mole.

16. A photographic emulsion according to claim 15 further characterized in that the transition metal complex is present in a concentration of from $2\times10^{-8}$ to $3\times10^{-5}$ mole per silver mole.

17. A photographic emulsion according to claim 15 further characterized in that $M^1$ is chosen from the class consisting of ruthenium and osmium and $L^1$ is chosen from the class consisting of chloride and bromide.

18. A photographic emulsion according to claim 10 further characterized in that said transition metal complex is present in an amount sufficient to reduce photographic speed.

19. A photographic emulsion according to claim 18 further characterized in that said transition metal complex is present in a concentration of less than $10^{-4}$ mole per silver mole.

20. A photographic emulsion according to claim 19 further characterized in that $M^1$ chosen from the class consisting of ruthenium and osmium and $L^1$ is chosen from the class consisting of chloride, bromide, and iodide.

21. A photographic emulsion according to claim 20 further characterized in that said transition metal complex is present in a concentration of from $1\times10^{-9}$ to $5\times10^{-5}$ mole per silver mole.

22. A photographic emulsion according to claim 11 further characterized in that said emulsion is surface sensitized with at least one of gold and middle chalcogen and said transition metal complex is present in a concentration sufficient to reduce low intensity reciprocity failure.

23. A photographic emulsion according to claim 22 further characterized in that said transition metal complex is present in a concentration of less than $1\times10^{-4}$ mole per silver mole.

24. A photographic emulsion according to claim 23 further characterized in that $M^1$ is chosen from the class consisting of rhenium, ruthenium, and osmium and $L^1$ is chloride.

25. A photographic emulsion according to claim 24 further characterized in that said transition metal complex is present in a concentration of from $1\times10^{-9}$ to $5\times10^{-5}$ mole per silver mole.

* * * * *